US006754926B2

(12) United States Patent
Wang

(10) Patent No.: US 6,754,926 B2
(45) Date of Patent: Jun. 29, 2004

(54) INFLATABLE BED

(76) Inventor: Cheng-Chung Wang, 12F, No. 440, Sec. 4, Jein Ai Rd., Taipei (TW)

( * ) Notice: Subject to any disclaimer, the term of this patent is extended or adjusted under 35 U.S.C. 154(b) by 173 days.

(21) Appl. No.: 10/233,994

(22) Filed: Aug. 29, 2002

(65) Prior Publication Data

US 2003/0200610 A1 Oct. 30, 2003

(51) Int. Cl.[7] ..... A47C 27/10
(52) U.S. Cl. ..... 5/710; 5/706; 5/655.3
(58) Field of Search ..... 5/706, 710, 711, 5/712, 732, 731, 739, 655.3

(56) References Cited

U.S. PATENT DOCUMENTS 6,015,471 A * 1/2000 Rimington et al. ..... 156/274.4

* cited by examiner

*Primary Examiner*—Heather Shackelford
*Assistant Examiner*—Lisa M Saldano
(74) *Attorney, Agent, or Firm*—Allston L. Jones

(57) ABSTRACT

An inflatable bed has a bottom surface that is disposed on a support surface and that is formed with a concave air bag. When a person moves onto a top surface of the bed, air is ejected from the air bag so that the bed acts as a suction cup, there by fixing the bed relative to the support surface.

9 Claims, 6 Drawing Sheets

INFLATABLE BED

BACKGROUND OF THE INVENTION

1. Field of the Invention

The invention relates to an inflatable bed, more particularly to an inflatable bed that can be produced at a relatively low cost.

2. Description of the Related Art

Referring to FIGS. 1 and 2, a conventional inflatable bed 200 is shown to comprise upper and lower mattress portions 7 which are heat-sealed to each other. Each mattress portion 7 has top and bottom sheets 71, 72, and an upstanding peripheral wall 74 that is bonded to peripheral portions of the top and bottom sheets 71, 72 by heat-sealing process so as to define an air inflatable chamber. Each mattress portion 7 includes a plurality of tensile members 73 heat-sealed to the top and bottom sheets 71, 72. Two annular sheets 75 are heat-sealed to the lower mattress portion 7 so as to form a first auxiliary air chamber 201 that surrounds a bottom end of the upper mattress portion 7, thereby positioning the mattress portions 7 relative to each other. Two opposite sides of the lower mattress portion 7 are heat-sealed respectively with a pair of lateral sheets 76 so as to form second auxiliary air chambers 202, thereby increasing the contact area of the lower mattress portion 7 relative to a ground surface, and thereby consequently positioning the conventional inflatable bed 200 on the ground surface.

However, the manufacturing cost of the conventional inflatable bed 200 is relatively high since aside from the materials used for producing the two mattress portions 7, additional material is required for the annular sheets 75 and the lateral sheets 76 as well. Furthermore, the conventional inflatable bed 200 is difficult to fabricate.

Referring to FIGS. 3 and 4, another conventional inflatable bed 200' is shown to include a top sheet 71', a bottom sheet 72', upper and lower rows of tensile members 73', a surrounding sheet 74', upper and lower lateral sheets 76', and a middle sheet 77'. The surrounding sheet 74' has a top end that is heat-sealed to a periphery of the top sheet 71', and a bottom end that is heat-sealed to a periphery of the bottom sheet 72' . The middle sheet 77' is disposed between the top and bottom sheets 71', 72', and has a periphery that is heat-sealed to the surrounding sheet 74' so as to define upper and lower chambers in the bed 200'. The upper lateral sheets 76' are heat-sealed respectively to two opposite sides of the lower end of the surrounding sheet 74', while the lower lateral sheets 76' are heat-sealed to two opposite sides of the bottom sheet 72' so as to define an air chamber 202' between each adjacent pair of the upper and lower lateral sheets 76'. The upper row of tensile members 73' are heat-sealed to the top sheet 71' and the middle sheet 77'. The lower row of tensile members 73' are heat-sealed to the middle sheet 771 and the bottom sheet 72'. Although the material requirement for the bed 200' is less than that for the bed 200 (see FIGS. 1 and 2), it is still difficult to manufacture the bed 200' because the upper and lower rows of the tensile members 73' are heat-sealed to the middle sheet 77' in a staggered arrangement.

SUMMARY OF THE INVENTION

Therefore, the main object of the present invention is to provide an inflatable bed that is capable of overcoming the aforementioned drawbacks of the prior art.

According to the present invention, an inflatable bed is disposed on a support surface, and includes a plastic top sheet that has a top surface, a bottom surface, and an outer periphery. A plastic bottom sheet is disposed under the top sheet, and has a lower end that is adapted to be disposed on the support surface, and an outer periphery. A plastic partition is interposed between the top and bottom sheets, and has an outer periphery that is spaced apart from and that is disposed between the outer peripheries of the top and bottom sheets so as to be adapted to define a concave air bag among the bottom sheet, the partition, and the support surface. A plastic pull band unit is used to connect fixedly the bottom surface of the top sheet to an assembly of the bottom sheet and the partition. A plastic annular surrounding sheet is disposed around the top sheet, the bottom sheet, and the partition, and is connected fixedly to the outer peripheries of the top sheet, the bottom sheet, and the partition. An upper air chamber is defined among the top sheet, the partition, and the surrounding sheet, and is disposed above the concave air bag. An annular lower peripheral air chamber is defined among the partition, the surrounding sheet, and the bottom sheet, and is disposed around the concave air bag. An inflatable unit is operable so as to introduce air into the upper air chamber and the annular lower peripheral air chamber. As such, when a person moves onto the top surface of the top sheet, air is ejected from the concave air bag via a space between the bottom sheet and the support surface so that the bed acts as a suction cup, thereby fixing the bed relative to the support surface.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
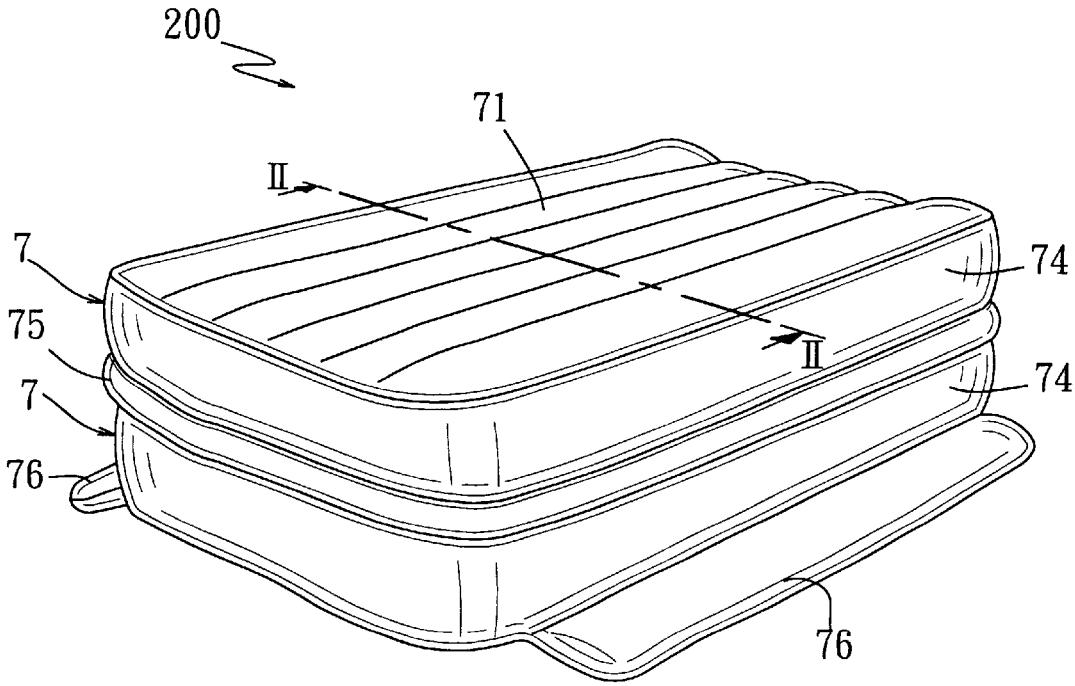
FIG. 1 PRIOR ART
FIG. 1 is a perspective view of a first conventional inflatable bed.
Figure 2:
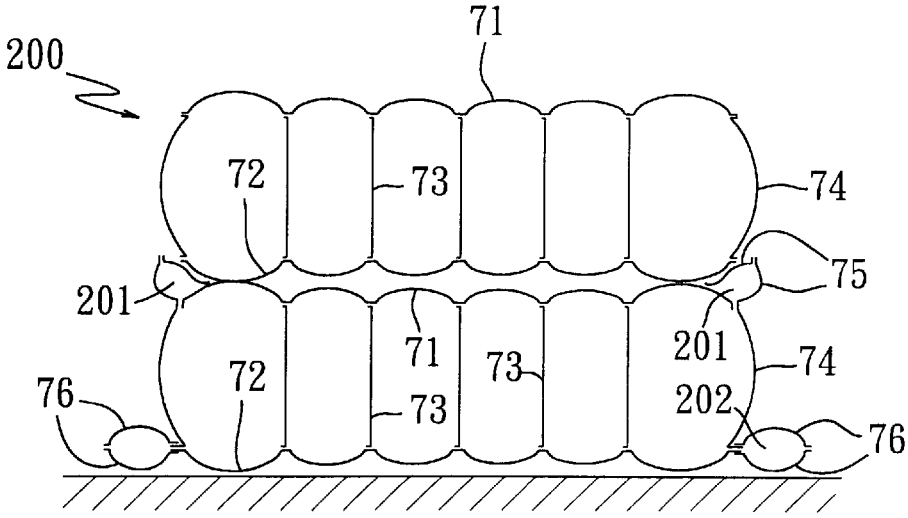
FIG. 2 PRIOR ART
FIG. 2 is a sectional view of the first conventional inflatable bed taken along line II—II of FIG. 1.
Figure 3:
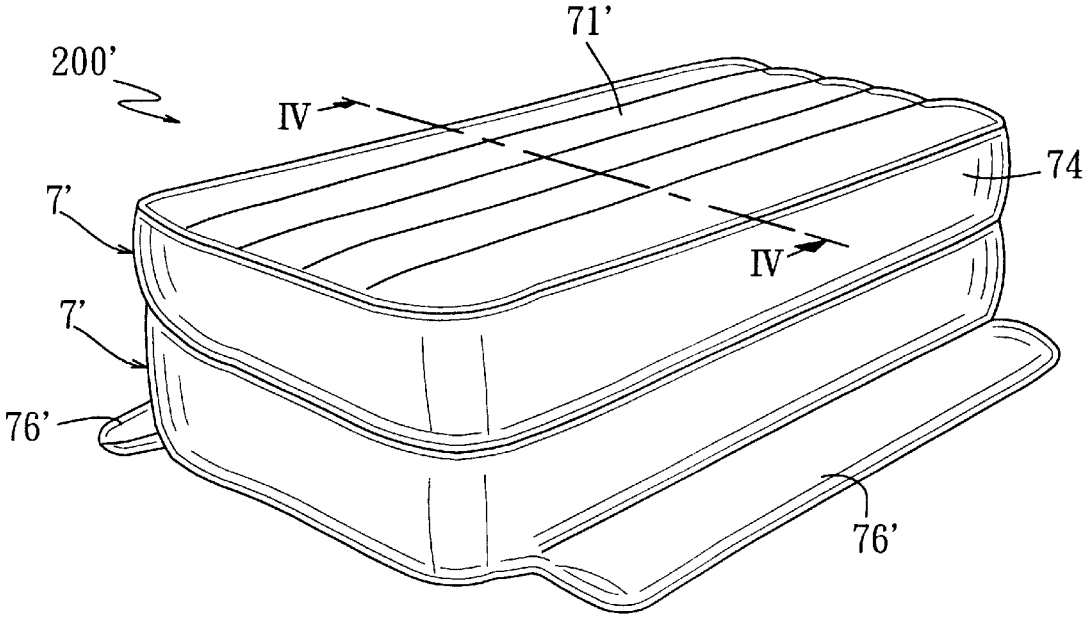
FIG. 3 PRIOR ART
FIG. 3 is a perspective view of a second conventional inflatable bed.
Figure 4:
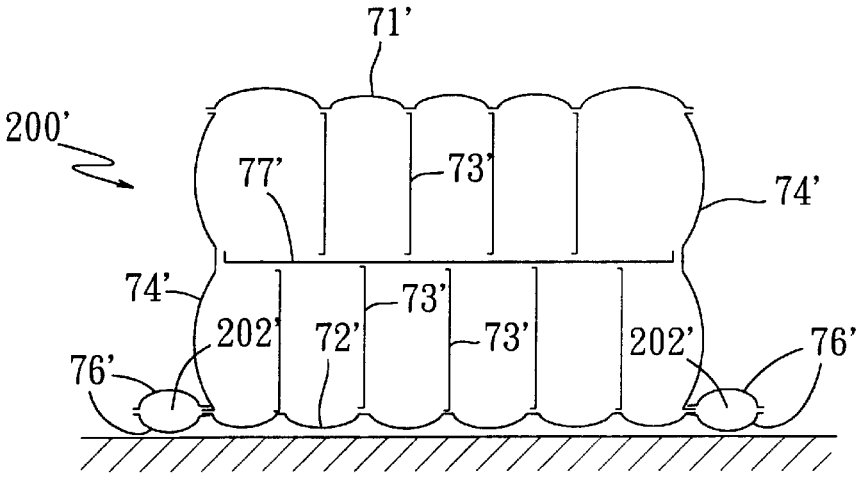
FIG. 4 PRIOR ART
FIG. 4 is a sectional view of the second conventional inflatable bed taken along line IV—IV of FIG. 3.

Before the present invention is described in greater detail, it should be noted that like elements are denoted by the same reference numerals throughout the disclosure.

Referring to FIGS. 5 to 8, the first preferred embodiment of an inflatable bed 100 according to the present invention is shown adapted to be disposed on a support surface 6, such as a floor or ground surface. The inflatable bed 100 comprises a plastic top sheet 1, a plastic bottom sheet 2, a plastic pull band unit 3, a plastic annular partition 4, a plastic annular surrounding sheet 5, and an inflatable unit.

The plastic top sheet 1 is elongated, and has a top surface 11, a bottom surface 12 opposite to the top surface 11, and an outer periphery 13.

The plastic bottom sheet 2 is disposed under the top sheet 1, and has an area approximately equal to that of the top sheet 1. The bottom sheet 2 has a central top portion 22 that is spaced apart from the top sheet 1, and an annular peripheral portion 23 that extends outwardly and downwardly from a periphery of the central top portion 22 so as to define a concave air bag 105 among the central top portion 22, the annular peripheral portion 23, and the support surface 6. The annular peripheral portion 23 has an upper end 231 that is connected fixedly to the periphery of the central top portion 22, a lower end 232 that is adapted to be disposed on the support surface 6, and an outer periphery 233.

Figure 5:
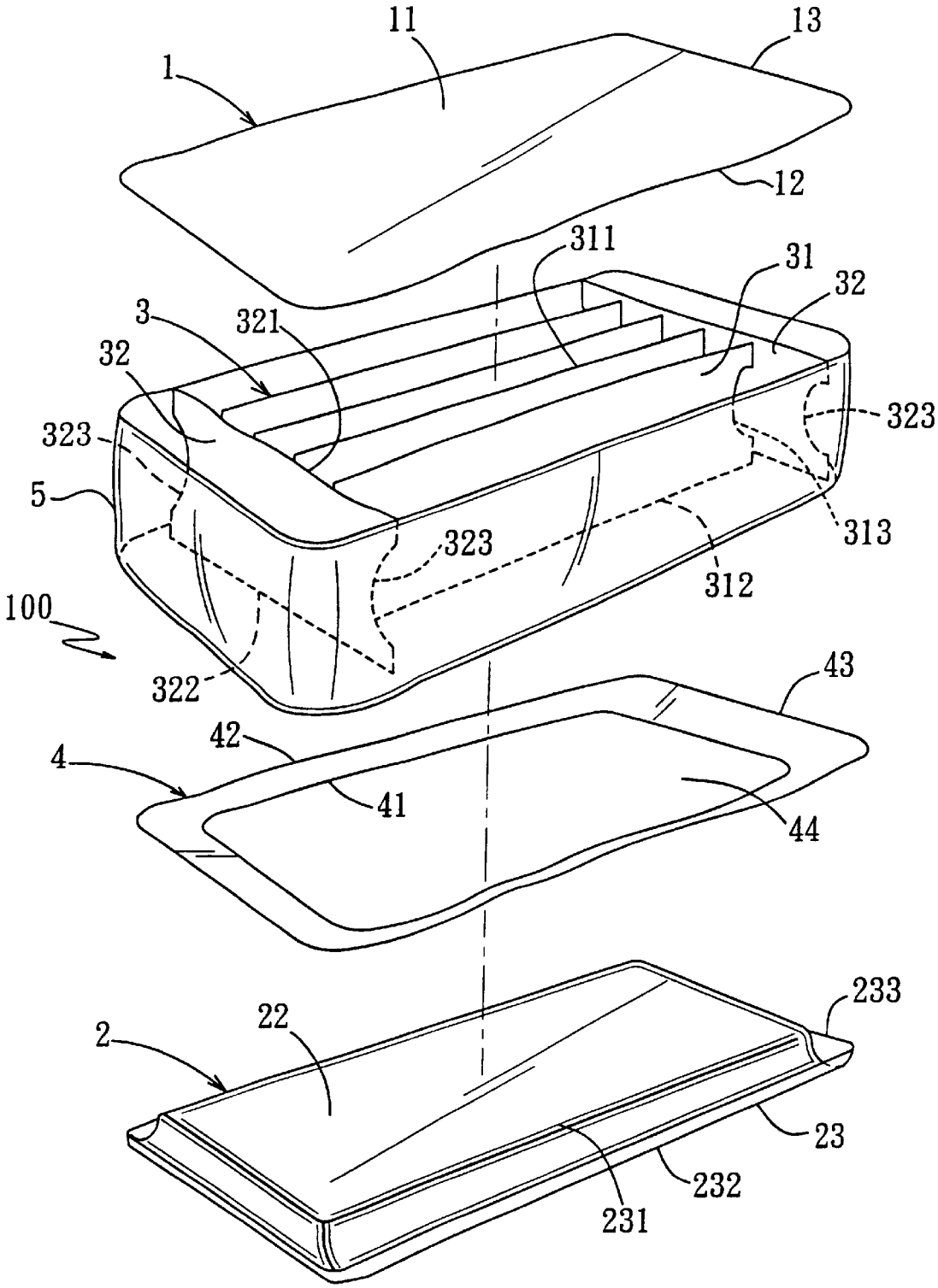
FIG. 5 is a partly exploded perspective view of the first preferred embodiment of an inflatable bed according to the present invention.
Figure 6:
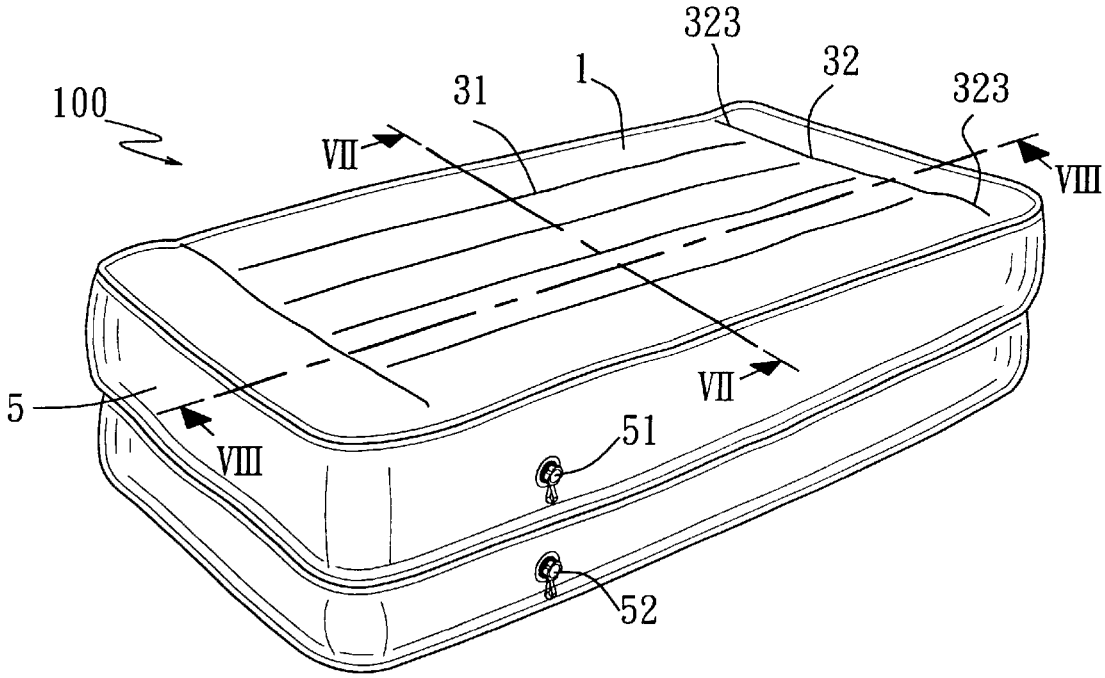
FIG. 6 is a perspective view of the first preferred embodiment in an assembled state.
Figure 7:
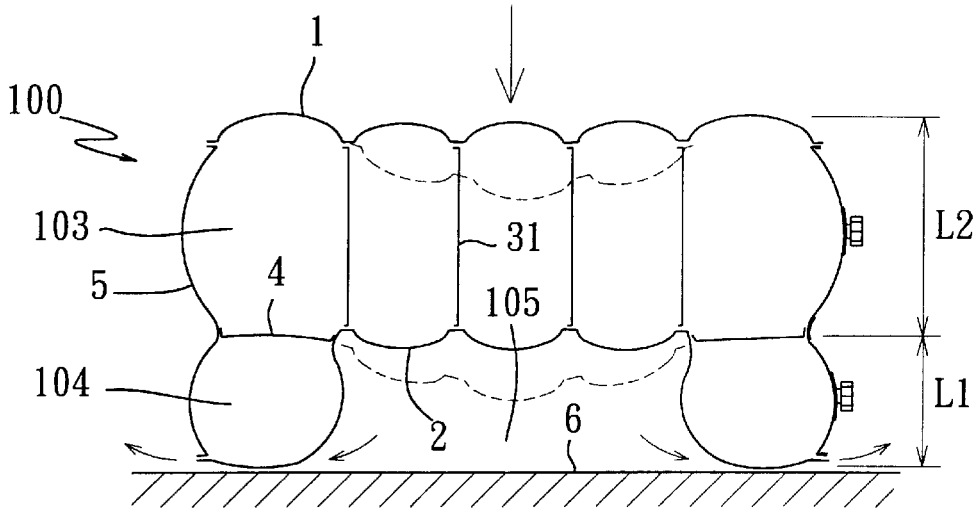
FIG. 7 is a sectional view of the first preferred embodiment taken along line VII—VII of FIG. 6.
Figure 8:
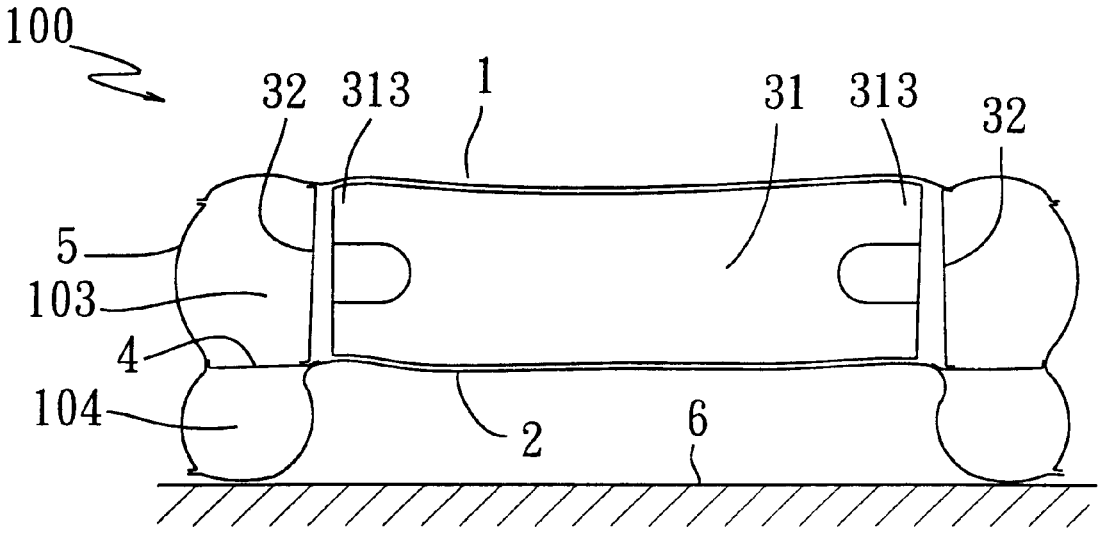
FIG. 8 is a sectional view of the first preferred embodiment taken along line VIII—VIII of FIG. 6.

The pull band unit 3 is provided for connecting fixedly the bottom surface 12 of the top sheet 1 to the central top portion 22 of the bottom sheet 2 and the partition 4 so that the top and bottom sheets 1, 2 are spaced apart from each other at a definite distance. In this embodiment, the pull band unit 3 includes a plurality of parallel longitudinal pull bands 31 and two transverse pull bands 32. Each of the longitudinal pull bands 31 extends along a longitudinal direction of the top sheet 1, and has a pair of upper and lower sides 311, 312 (see FIG. 5) that are connected respectively and fixedly to the top and bottom sheets 1, 2. Each of the transverse pull bands 32 has a pair of upper and lower sides 321, 322 (see FIG. 5) that are connected respectively and fixedly to the top sheet 1 and the partition 4, and two ends 323 that are spaced apart from the surrounding sheet 5, as shown in FIGS. 5 and 6. Each of the longitudinal pull bands 31 further has two ends 313 that are spaced apart from the transverse pull bands 32, as shown in FIG. 8.

The plastic annular partition 4, in this embodiment, is an annular plastic sheet. The partition 4 is horizontal, is generally aligned with the central top portion 22 of the bottom sheet 2, and has an inner periphery 41, an outer periphery 42, and a hole 44. The inner periphery 41 is connected fixedly to the upper end 231 of the annular peripheral portion 23 of the bottom sheet 2 by heat-sealing process. The outer periphery 42 is spaced apart from and is disposed between the outer peripheries 13, 233 of the top and bottom sheets 1, 2. During assembly, a rectangular plastic sheet is heat-sealed to the annular peripheral portion 23 of the bottom sheet 2. Subsequently, the central sheet portion of the rectangular plastic sheet, which is disposed within the annular heat-sealing line, is removed so as to form the annular partition 4. Alternatively, the partition 4 may be a pre-formed annular plastic sheet.

The plastic annular surrounding sheet 5 is disposed to surround the top sheet 1, the bottom sheet 2, and the partition 4, and is connected fixedly to the outer peripheries 13, 43, 233 of the top sheet 1, the partition 4, and the annular peripheral portion 23 of the bottom sheet 2 by heat-sealing process so as to define an upper air chamber 103 among the top sheet 1, the partition 4, the surrounding sheet 5, and the center top portion 22 of the bottom sheet 2, and an annular lower peripheral air chamber 104 among the partition 4, the surrounding sheet 5, and the annular peripheral portion 23 of the bottom sheet 2.

The annular partition 4 is disposed between the upper air chamber 103 and the lower peripheral air chamber 104 so as to prevent air communication therebetween. However, a port (not shown) may be formed through the partition 4 so as to permit air communication between the upper air chamber 103 and the lower peripheral air chamber 104.

The assembly of the bottom sheet 2 and the partition 4 can be modified. For example, the partition 4 has no hole 44 (see FIG. 5). The bottom sheet 2 is annular, and has an upper end that is attached fixedly to the bottom surface of the top sheet 1.

The inflatable unit is operable so as to introduce air into the upper air chamber 103 and the lower peripheral air chamber 104, and includes two air inlets and two air valves 51, 52 (see FIG. 6) . The air inlets are formed in the surrounding sheet 5, and are in fluid communication with the upper air chamber 103 and the lower peripheral air chamber 104, respectively. The air valves 51, 52 are disposed respectively within the air inlets.

After air is inflated into the upper air chamber 103 and the lower peripheral air chamber 104 of the inflatable bed 100, a person can move onto the top surface 11 of the bed 100. A downward force is exerted on the top sheet 1 at this moment due to the body weight of the person, thereby deforming the top sheet 1. Air in the concave air bag 105 is ejected at the same time via a space between the lower end 232 of the annular peripheral portion 23 of the bottom sheet 2 and the support surface 6 so that the bed 100 acts as a suction cup, thereby fixing the bed 100 relative to the support surface 6 (see FIG. 7). When the person leaves the bed 100, the upper air chamber 103 can be restored to its original shape, and the concave air bag 105 can be once again filled with air. The inflatable bed 100 can be easily moved at this time.

Referring back to FIG. 7, in actual practice, the concave air bag 105 has a height (L1) that is slightly larger than one half of a height (L2) of the upper air chamber 103 so that the central portion of the upper air chamber 103 can have a sufficient space to permit downward deformation of the upper air chamber 103.

Figure 9:
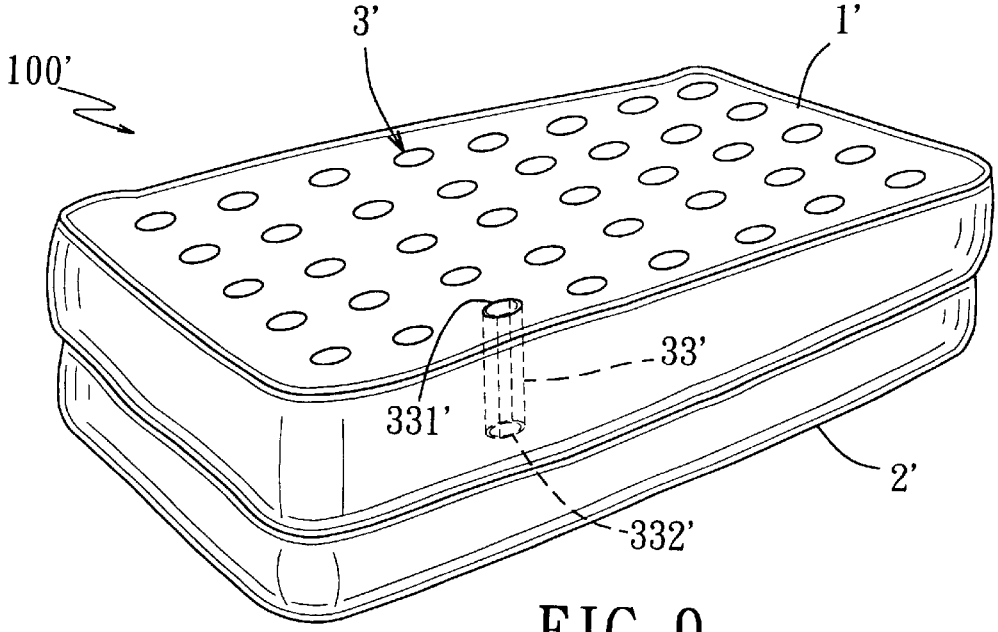
FIG. 9 is a perspective view of the second preferred embodiment of an inflatable bed according to the present invention.

The second preferred embodiment of an inflatable bed 100' according to the present invention is shown in FIG. 9 to be substantially similar to the first preferred embodiment in construction. However, in this embodiment, the pull band unit 3' includes a plurality of vertical tubular pull bands 33', each of which has a pair of upper and lower ends 331', 332' that are connected respectively and fixedly to the top and bottom sheets 1', 2'.

Figure 10:
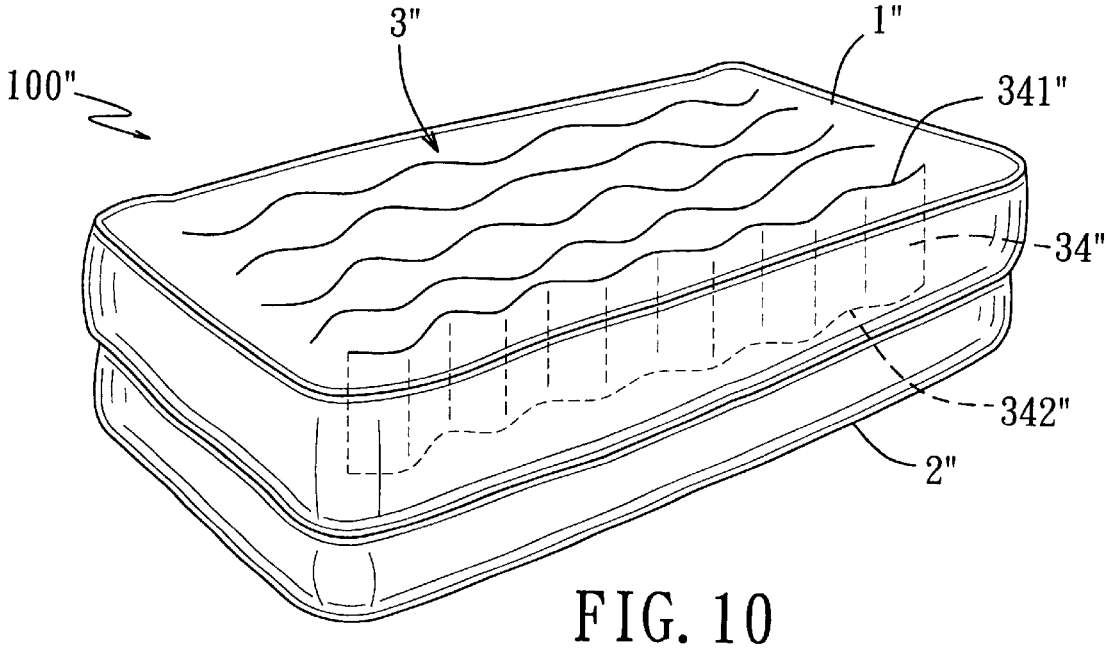
FIG. 10 is a perspective view of the third preferred embodiment of an inflatable bed according to the present invention.

The third preferred embodiment of an inflatable bed 100" according to the present invention is shown in FIG. 10. In this embodiment, the pull band unit 3" includes a plurality of curved pull bands 34", each of which has a pair of upper and lower sides 341", 342" that are connected respectively and fixedly to the top and bottom sheets 1", 2".

From the aforementioned embodiments of the inflatable bed 100, 100', 100" of the present invention, it is apparent that the inflatable beds 100, 100', 100" are relatively simple in construction, and are easy to manufacture such that the manufacturing costs of the beds 100, 100', 100" can be reduced to a minimum.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An inflatable bed adapted to be disposed on a support surface, said inflatable bed comprising:

a plastic top sheet having a top surface, a bottom surface, and an outer periphery;

a plastic bottom sheet disposed under said top sheet and having a lower end that is adapted to be disposed on the support surface, and an outer periphery;

a plastic partition interposed between said top and bottom sheets and having an outer periphery that is spaced apart from and that is disposed between said outer peripheries of said top and bottom sheets so as to be adapted to define a concave air bag among said bottom sheet, said partition, and the support surface;

a plastic pull band unit for connecting fixedly said bottom surface of said top sheet to an assembly of said bottom sheet and said partition;

a plastic annular surrounding sheet disposed around said top sheet, said bottom sheet, and said partition and connected fixedly to said outer peripheries of said top sheet, said bottom sheet, and said partition so as to define an upper air chamber that is disposed among said top sheet, said partition, and said surrounding sheet and that is disposed above said concave air bag, and an annular lower peripheral air chamber that is disposed among said partition, said surrounding sheet, and said bottom sheet and that is disposed around said concave air bag; and an inflatable unit operable so as to introduce air into said upper air chamber and said annular lower peripheral air chamber;

whereby, when a person moves onto said top surface of said top sheet, air is ejected from said concave air bag via a space between said bottom sheet and the support surface so that said bed acts as a suction cup, thereby fixing said bed relative to the support surface.

2. The inflatable bed as claimed in claim 1, wherein said bottom sheet has a central top portion that is spaced apart from said top sheet, and an annular peripheral portion that extends outwardly and downwardly from a periphery of said central top portion so as to define said concave air bag among said central top portion, said annular peripheral portion, and the support surface, said annular peripheral portion having an upper end that is connected fixedly to said periphery of said central top portion, and a lower end that is adapted to be disposed on the support surface;

said partition having an inner periphery that is connected fixedly to an upper portion of said annular peripheral portion of said bottom sheet;

said pull band unit being connected fixedly to said bottom surface of said top sheet and an assembly of said central top portion of said bottom sheet and said partition;

said upper air chamber being defined among said top sheet, said partition, said surrounding sheet, and said center top portion of said bottom sheet, said lower peripheral air chamber being defined among said partition, said surrounding sheet, and said annular peripheral portion of said bottom sheet.

3. The inflatable bed as claimed in claim 2, wherein said inner periphery of said partition is connected fixedly to said upper end of said annular peripheral portion of said bottom sheet, said partition being horizontal and being generally aligned with said central top portion of said bottom sheet.

4. The inflatable bed as claimed in claim 3, wherein said lower peripheral air chamber has a height that is slightly larger than one half of a height of said upper air chamber.

5. The inflatable bed as claimed in claim 3, wherein said top sheet is elongated, said pull band unit including a plurality of parallel longitudinal pull bands, each of which extends along a longitudinal direction of said top sheet, each of said longitudinal pull bands having a pair of upper and lower sides that are connected respectively and fixedly to said top and bottom sheets.

6. The inflatable bed as claimed in claim 4, wherein said pull band unit further includes two transverse pull bands, each of which has a pair of upper and lower sides that are connected respectively and fixedly to said top sheet and said partition.

7. The inflatable bed as claimed in claim 2, wherein said pull band unit includes a plurality of vertical tubular pull bands, each of which has a pair of upper and lower ends that are connected respectively and fixedly to said top sheet and the assembly of said central top portion of said bottom sheet and said partition.

8. The inflatable bed as claimed in claim 2, wherein said pull band unit includes a plurality of curved pull bands, each of which has a pair of upper and lower sides that are connected respectively and fixedly to said top sheet and the assembly of said central top portion of said bottom sheet and said partition.

9. The inflatable bed as claimed in claim 2, wherein said partition is disposed between said upper air chamber and said lower peripheral air chamber so as to prevent air communication therebetween, said inflatable unit including two air inlets that are formed in said surrounding sheet and that are in fluid communication with said upper air chamber and said lower peripheral air chamber, respectively, and two air valves that are disposed respectively within said air inlets.

* * * * *